US007261231B2

(12) United States Patent
Kuhn et al.

(10) Patent No.: US 7,261,231 B2
(45) Date of Patent: Aug. 28, 2007

(54) PIZZA BOX

(75) Inventors: Wayne H. Kuhn, Palos Park, IL (US); Frank Pizzitola, Streamwood, IL (US)

(73) Assignee: International Paper Company, Memphis, TN (US)

( * ) Notice: Subject to any disclaimer, the term of this patent is extended or adjusted under 35 U.S.C. 154(b) by 271 days.

(21) Appl. No.: 10/865,540

(22) Filed: Jun. 10, 2004

(65) Prior Publication Data

US 2005/0274779 A1 Dec. 15, 2005

(51) Int. Cl.
*B65D 5/00* (2006.01)
*B65D 43/00* (2006.01)

(52) U.S. Cl. ..... 229/114; 229/122; 229/124; 229/126; 229/143; 229/149; 229/906; 229/915; 229/933

(58) Field of Classification Search ..... 229/112, 229/114, 122, 124, 126, 128, 143, 149, 150, 229/902, 906, 915, 933, 935, 936
See application file for complete search history.

(56) References Cited

U.S. PATENT DOCUMENTS 2,041,021 A * 5/1936 William ..... 229/149
2,529,725 A * 11/1950 Currie ..... 229/935
2,547,716 A * 4/1951 Murphy ..... 229/149
2,838,222 A * 6/1958 Constantine ..... 229/112
2,962,202 A * 11/1960 Hansen ..... 229/935
3,252,650 A 5/1966 Pryor
3,703,256 A * 11/1972 Ross ..... 229/149
4,655,386 A * 4/1987 Billberg ..... 229/935
4,804,136 A * 2/1989 Hall ..... 229/112
4,917,291 A 4/1990 Saiki et al.
4,984,734 A * 1/1991 Zion et al. ..... 229/915
5,226,588 A * 7/1993 Schramm et al. ..... 229/149
5,289,970 A * 3/1994 McClure ..... 229/143
5,305,951 A 4/1994 Kuhn et al.
5,516,036 A 5/1996 Maultasch et al.
5,752,651 A 5/1998 Correll
6,547,125 B2 4/2003 Correll
6,915,949 B1 7/2005 Economopoulos
2001/0032874 A1 10/2001 Philips
2002/0130168 A1 9/2002 McClure

FOREIGN PATENT DOCUMENTS

FR 2363489 A1 3/1978
FR 2676035 A1 * 11/1992

* cited by examiner

*Primary Examiner*—Gary E. Elkins
(74) *Attorney, Agent, or Firm*—Thomas W. Barnes, III; Jeffrey S. Sokol; Daniel C. Stelter

(57) ABSTRACT

A folded food carton is formed from a matable, lay flat blank for retaining, transporting and serving hot food such as pizza. The blank includes an arrangement of end panels, side panels and cover panels foldable relative to a bottom panel such that, in the erected carton, the cover panels overlap and are interlocked with the side panels by means of offset locking tabs. The end panels slant upwardly and inwardly from the bottom panel to add rigidity and save material for the carton. The side panels flare upwardly and outwardly from the bottom panel and extend above the cover panels to enhance stackability and prevent shifting of stacked cartons one on top of the other. Several methods of packaging pizza in the folded carton are disclosed.

17 Claims, 14 Drawing Sheets

PIZZA BOX

FIELD OF THE INVENTION

The present invention generally pertains to a food container constructed from an integral sheet of material, and more particularly to pizza box formed from a corrugated paperboard blank for retaining, transporting and serving a hot pizza.

BACKGROUND OF THE INVENTION

It is well known that pizza businesses make and sell millions of hot pizzas for delivery and carryout. The success of these business depends to an extent on the cost and functionality of the folded cartons utilized in packaging the pizza product. Ideally, it is recognized that these cartons should be cost economical, easy to use, stackable, rigid and crush-resistant.

Some of these cartons are known to employ inward-slanting wall constructions in an effort to conserve manufacturing costs, and attain maximum stacking strength. Certain cartons employ various rigid cover structures and avoid the use of any tabs projecting above their cover structure so as to allow stacking of multiple cartons one on top of the other. Other carton designs rely on foldable blanks capable of being manufactured in nested and inverted configuration in order to achieve a minimum of material consumption.

Moreover, the majority of prior art folded pizza cartons are intended to be used in a manner which requires several steps. These steps include pre-erecting the carton, stacking empty pre-erected cartons on the shelf, removing a pre-erected carton from the shelf and opening a pre-erected carton. Then, a pizza is removed from an oven and placed on a counter surface for cutting after which the sliced pizza is transferred from the counter surface to the opened carton that must be reclosed.

Several drawbacks are inherently unavoidable in using the prior art cartons to package pizza. For example, the previous carton designs necessitate additional labor in pre-erecting the cartons and create potential contamination when the pizza is placed on a counter surface for cutting. During the cutting process, the pizza starts cooling which is undesirable to the consumer. Further labor is required to transfer the pizza to the pre-erected open carton and reclose the carton.

It should also be appreciated that once a pizza is boxed, it is important to let the moisture out of the carton to prevent soggy pizza. Prior art pizza cartons generally accomplish this task by venting the carton through seams or gaps between the end walls or sidewalls and the cover structure, or through other vent holes formed in the carton surface.

Mindful of such prior art structure and use, there remains a need for a material-saving, quickly-erected, food carton especially useful in packaging hot pizza. It is particularly desirable to provide a packaging structure which improves the rigidity, stackability, venting capability and cost effectiveness of the carton and use thereof.

SUMMARY OF THE INVENTION

It is a general object of the present invention to provide a folded food carton which is highly efficient in structure and use.

It is also an object of the present invention to provide a folded food carton formed from a unique, symmetrical blank with a lay flat design that speeds cutting, packaging and serving of food to be packaged in the carton.

It is a further object of the present invention to provide a folded food carton having end panels, side panels and cover panels which enhance the strength and stackability of the food package.

It is an additional object of the present invention to provide a folded food carton blank which is matable in side-to-side configuration so as to optimize a pizza packaging operation.

It is another object of the present invention to provide a folded food carton design which reduces labor requirements and lessens the possibility of contamination of the pizza to be packaged.

Yet a further object of the present invention is to provide a folded food carton which does not necessarily require pre-erecting.

Still another object of the present invention is to provide a folded food carton which retains heat of a pizza packaged therein while preventing condensation from forming on the pizza due to its venting capability.

Furthermore, it is an object of the present invention to provide an efficient method of packaging a hot food product such as pizza using the folded carton.

The present invention is directed to a folded food carton adapted to retain, transport and serve hot pizza. The folded food carton is formed from a blank that includes a substantially rectangular bottom panel, and a pair of opposed end panels hingedly secured to the bottom panel along a pair of opposed, first transverse fold lines. A pair of opposed cover panels is hingedly attached to the end panels along a pair of opposed second transverse fold lines. Each cover panel has a set of locking tabs extending outwardly from lateral edges thereof. Each end panel has opposed side edges diverging outwardly from ends of the first transverse fold lines to ends of the second transverse fold lines. A pair of side panels is hingedly connected to the bottom panel along a pair of opposed longitudinal fold lines. Each side panel is formed with openings for frictionally receiving the locking tabs on the cover panels. Upon folding the side panels, end panels and cover panels, the cover panels overlap each other and are interlocked with the side panels by means of the locking tabs engaging walls forming the side panel openings. The end panels slant inwardly and upwardly relative to the bottom panel, and the side panels slant outwardly and upwardly relative to the bottom panel and extend above the cover panels.

In the preferred embodiment, the end panels are substantially trapezoidal in shape. The side edges of each side panel extend at an acute angle relative to the second transverse fold lines. Each cover panel is substantially rectangular and each locking tab is formed with a pair of outwardly diverging edges on a pair of outwardly extending, converging edges. The locking tabs on each cover panels are offset with one locking tab lying adjacent the second transverse fold line, and the other locking tab being positioned adjacent an outer end of the cover panel. The longitudinal fold lines lie parallel to a longitudinal axis passing through the bottom panel, and the first and second transverse lines lie parallel to each other and transverse to the longitudinal axis. Each side panel is formed with a contoured outer edge, a pair of shoulders and a pair of side edges disposed at acute angles relative to one of the longitudinal fold lines. The contoured outer edge includes a pair of spaced apart extended portions and a pair of spaced apart recesses. The extended portions and recesses on the one side panel are offset relative to the extended portions and recesses on the opposite side panel. The openings formed in each side panel lie inwardly of the extended portions. The openings are strategically sized to permit venting of a hot food product packaged in the carton. Upon folding the end panels, the side panels and the cover panels, the end panels are oriented at an acute angle relative to the bottom panel. The side panels are oriented at an obtuse angle relative to the bottom panel. The outwardly-slanting side panels facilitate vertical stacking of other cartons one on top of the other and define guides to prevent side-to-side shifting of other cartons stacked on the cover panels.

In one aspect of the invention, a foldable blank is provided for a food carton having a longitudinal axis passing therethrough. The blank has opposed side panels wherein the extended portions and recesses on one side panel are offset and out of alignment with extended portions and recesses on the other side panel. When two blanks are disposed adjacent each other in side-by-side configuration, the extended portions and the recesses on a left side of a right hand blank matingly engage the extended portions and recesses on a right side of a left hand blank.

The invention contemplates a method of packaging a pizza baked in an oven in a folded container wherein the method comprises the steps of providing a lay flat blank having a bottom panel, end panels, cover panels and side panels as previously described above; positioning and slicing a pizza removed directly from an oven on the bottom panel; folding the side panels upwardly along the longitudinal fold lines; folding the end panels upwardly along the first transverse fold lines; folding the cover panels along the second transverse fold lines in overlapping relationship; and moving the side panels inwardly to frictionally interlock the locking tabs with walls forming the openings.

The invention further discloses a method of packaging multiple pizzas baked in an oven in respective folding cartons using a pair of lay flat matable blanks in side-to-side configuration. Also disclosed is a method of packaging a pizza baked in an oven in a folded carton by loading the pizza onto the bottom panel by means of a unfolded side panel.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

The folded food carton embodying the present invention is formed from a blank typically constructed of corrugated paperboard but may otherwise be fabricated of other suitable foldable materials. The intended use for this carton is for the retention, storage and serving of pizza. However, it should be understood that the invention is not restricted in use and may have broader applications for containment of other articles.

Figure 1:
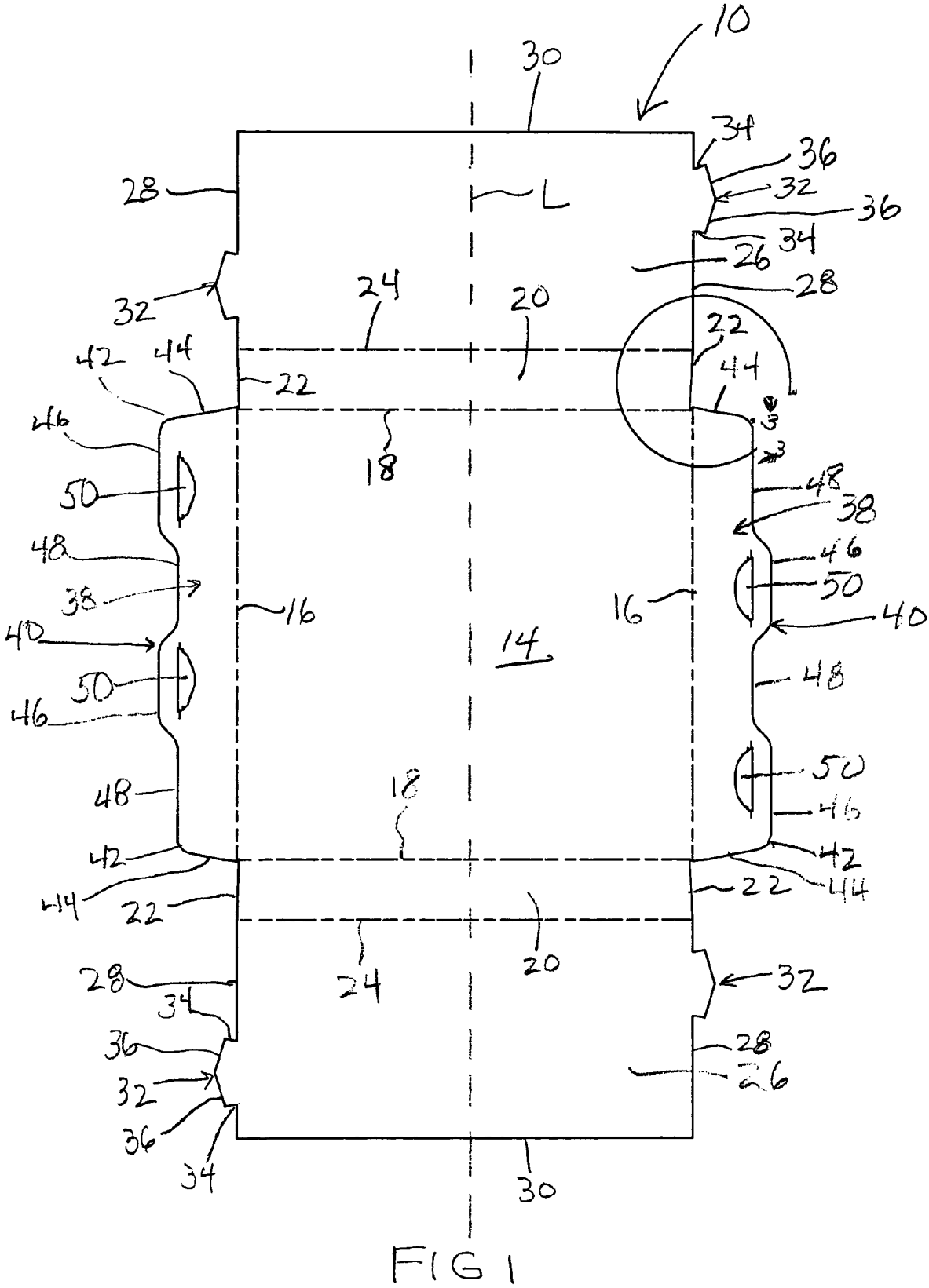
FIG. 1 is a plan view of a blank for a folded food carton embodying the present invention.
Figure 2:
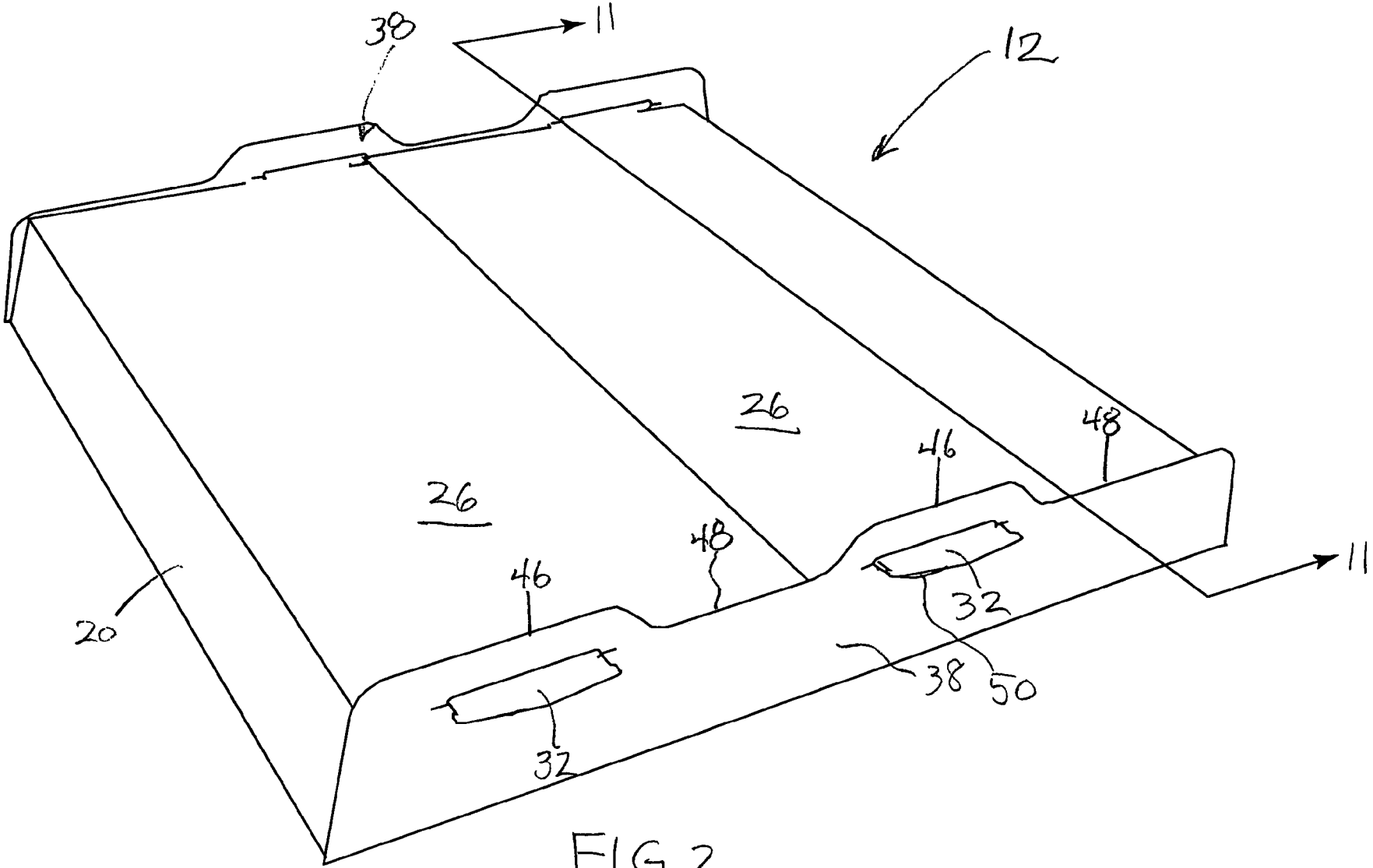
FIG. 2 is a perspective view of a folded food carton formed from the blank of FIG. 1.
Figure 3:
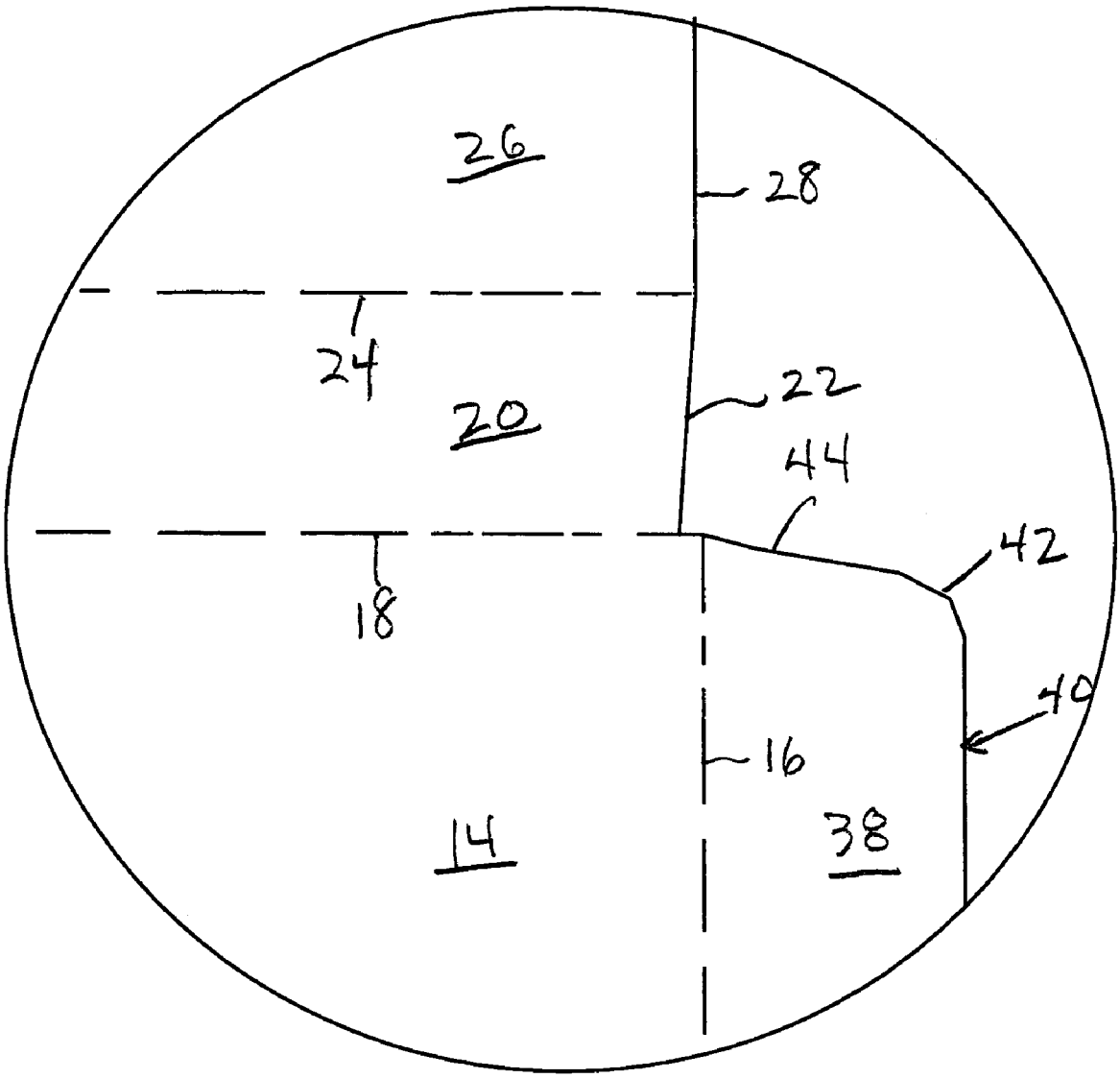
FIG. 3 is an enlarged detailed view taken on line 3-3 of FIG. 1.

A cardboard blank for a pizza box is shown in FIG. 1, and generally designated by reference number 10. The blank 10 is substantially flat symmetrical. As discussed below, the blank 10 folds into a closed position to construct a fully assembled carton, such as a pizza box 12 shown in FIG. 2. The blank 10 is preferably an integral piece of material such as a continuous sheet of conventional corrugated cardboard. The blank 10 is cut along its outer margins to form its specific shape. The blank 10 has a longitudinal axis L and includes a rectangular bottom panel 14 having a pair of opposed, longitudinal fold lines 16, and a pair of opposed, first transverse fold lines 18. Two relatively narrow opposed trapezoidal end panels 20 are hingedly joined or otherwise attached to the bottom panel 14 along transverse fold lines 18. The end panels 20 have opposed side edges 22 which angle or diverge slightly outwardly from the ends of first transverse fold lines 18 to ends of second transverse fold lines 24 as best seen in FIG. 3. The transverse fold lines 24 are substantially parallel to the transverse fold lines 18, and enable a hinged securement of outer edges of the end panels 20 to a pair of opposed cover panels 26.

Each cover panel 26 is substantially rectangular in shape and includes a pair of lateral edges 28 and an outer end 30. The outer ends 30 are parallel to fold lines 18 and 24. Each lateral edge 28 has an integral outwardly extending locking tab 32. On each cover panel 26, the opposed tabs 32 are offset relative to each other with one of the tabs 32 being located proximal the fold line 24 and the other of tabs 32 being positioned proximal its outer end 30. Each tab 32 has outwardly diverging edges 34 and outwardly sloping, converging edges 36 that merge together. Each outer edge 30 has a slot or interlock mechanism (not shown) toward its middle section as discussed below.

A pair of side panels 38 is hingedly joined or attached to the bottom panel 14 along longitudinal fold lines 16. Each side panel 38 is formed with a notched or contoured outer edge 40, shoulders 42 and side edges 44 disposed at an acute angle with respect to longitudinal fold line 16. Each notched outer edge 40 defines a pair of spaced apart extended portions 46 and a pair of spaced apart recesses 48. In addition, each side panel 38 is provided with a pair of tab-receiving openings 50 which lie inwardly of the extended portions 46. As seen in FIG. 1, the extended portions 46, recesses 48 and openings 50 of one side panel 38 are offset and non-aligned with the extended portions 46, recesses 48 and openings 50 of the other side panel 38 for a particular purpose to be described below.

Figure 4:
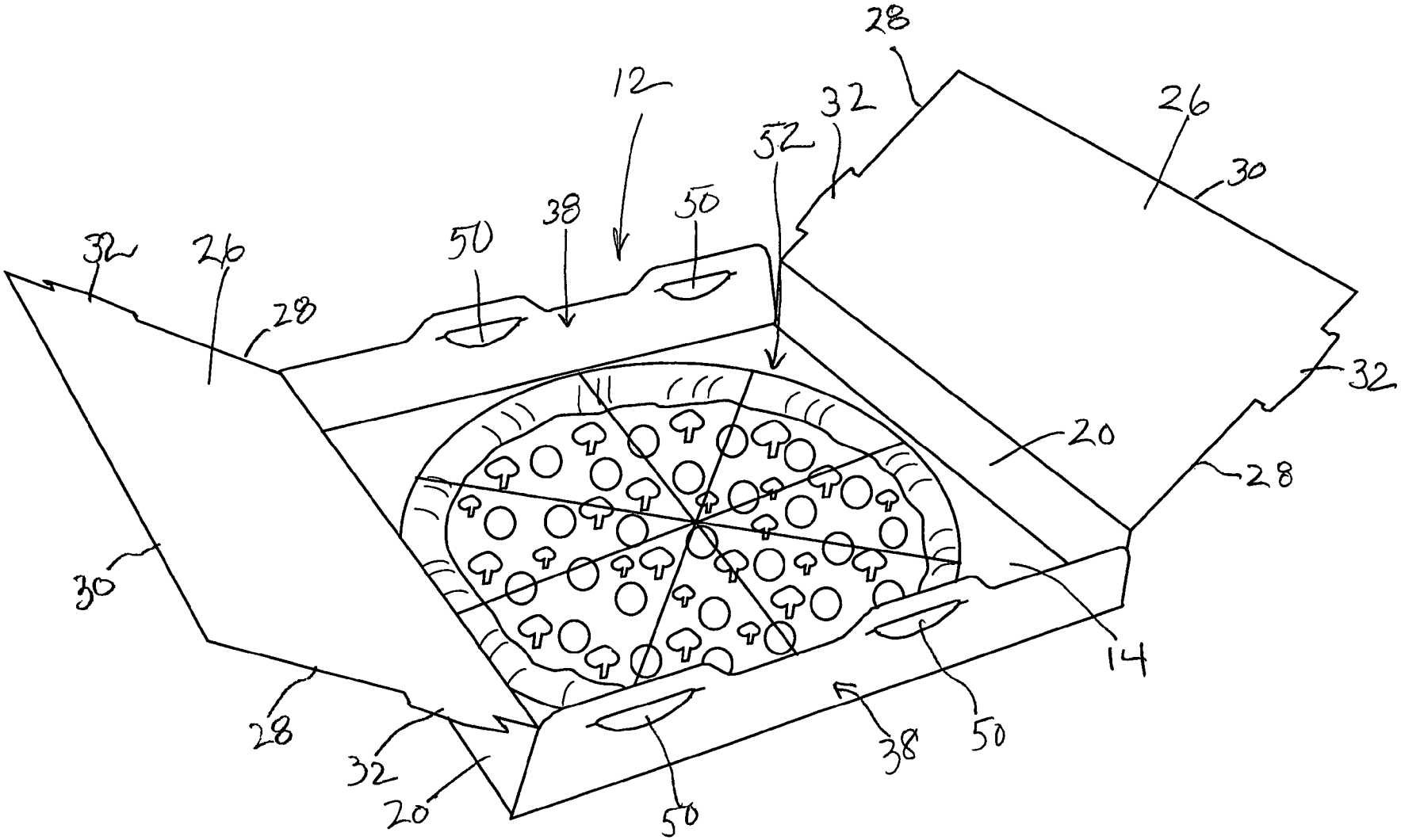
FIG. 4 is a perspective view of a food carton containing a pizza with both cover panels folded open.
Figure 5:
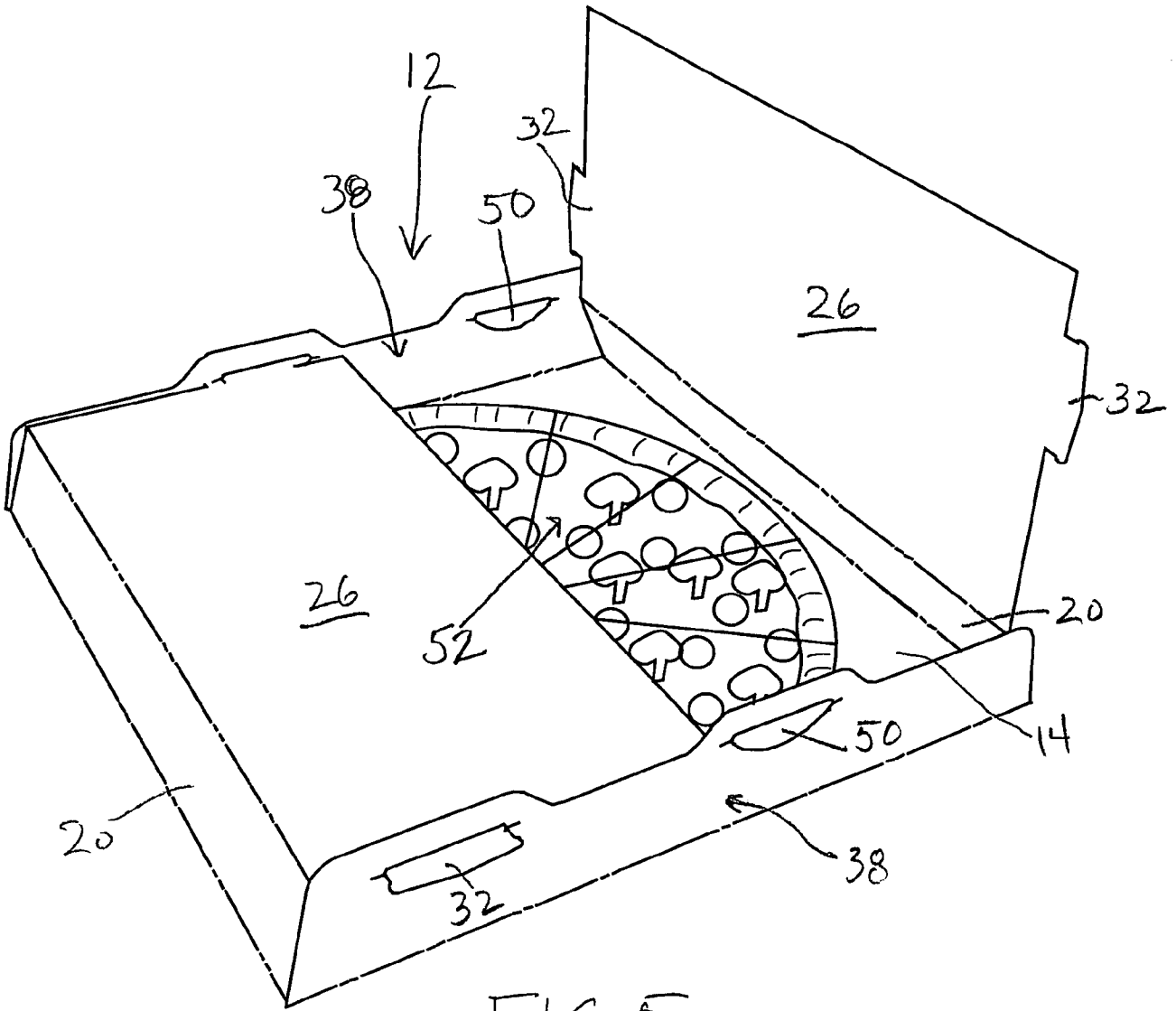
FIG. 5 is a view like FIG. 4 showing only one cover panel folded open.

In use, an article 52, such as a pizza taken directly from an oven, is positioned and cut upon the bottom panel 14 while the blank 10 remains flat on a supporting surface as in FIG. 1. The flat orientation of the blank 10 and carton 12 facilitate the cutting of the pizza without damage to or interference from its end and side panels 20 and 38, it being understood that the bottom panel 14 and carton are sized to accommodate the pizza. The side panels 38 are then folded upwardly about fold lines 16 and then the end panels 20 are folded upwardly about fold lines 18 as shown in FIG. 4. Then, each cover panel 26 is folded inwardly about a respective fold line 24 so that the tabs 32 on each cover panel 26 seek the tab-receiving openings 50 in the side panels 38 as the outer ends 30 of the cover panels 26 slightly overlap. The slots in the outer end 30 mate or otherwise interlock or join together. The interlocking slots provide extra strength toward the center of the box 12 when it is in its closed position. The slots help resist the force of a person or other object pushing down on the center of the box 12. Thereafter, the side panels 38 are urged inwardly to enable the diverging edges 34 of the tabs 32 to frictionally engage the upper walls defining the tab-receiving openings 50. Once the pizza 52 has been efficiently boxed, the carton 12 is ready for delivery to or pick up by a customer. Carton 12 is used to serve the pizza 52 either by opening both cover panels 26 as shown in FIG. 4, or a single cover panel 26 as shown in FIG. 5.

The cover panels 26 thus interlock with the side panels 38 to reinforce each other and provide strength to the top of the carton 12. It should be appreciated that when boxing hot pizza 52, it is important to prevent a soggy product by letting moisture escape from the carton 12. While some moisture is released by the seams or gaps between the inside surfaces of the side panels 38 and the lateral edges 28 of the cover panels 26, the lower portions of the tab-receiving openings 50 are sized to further allow for venting of the moisture. With this design, the carton 12 is able to retain sufficient heat to keep the pizza 52 at a desirable temperature while preventing condensation from forming thereon.

From the foregoing, it should be understood that the preferred use of the blank 10 facilitates a highly efficient and economic food packaging operation in comparison with prior art pizza packaging. Use of the present invention eliminates the prior art handling steps of pre-erecting a carton, stacking multiple pre-erected cartons on a shelf, removing a pre-erected carton from the shelf, opening the pre-erected carton, placing the pizza on a counter surface for cutting after being removed from the oven, moving the cut pizza (which may have since cooled) to the open carton and then re-closing the carton. In addition, loading the pizza 52 directly from the oven reduces labor costs and prevents potential contamination from the counter surface.

Figure 6:
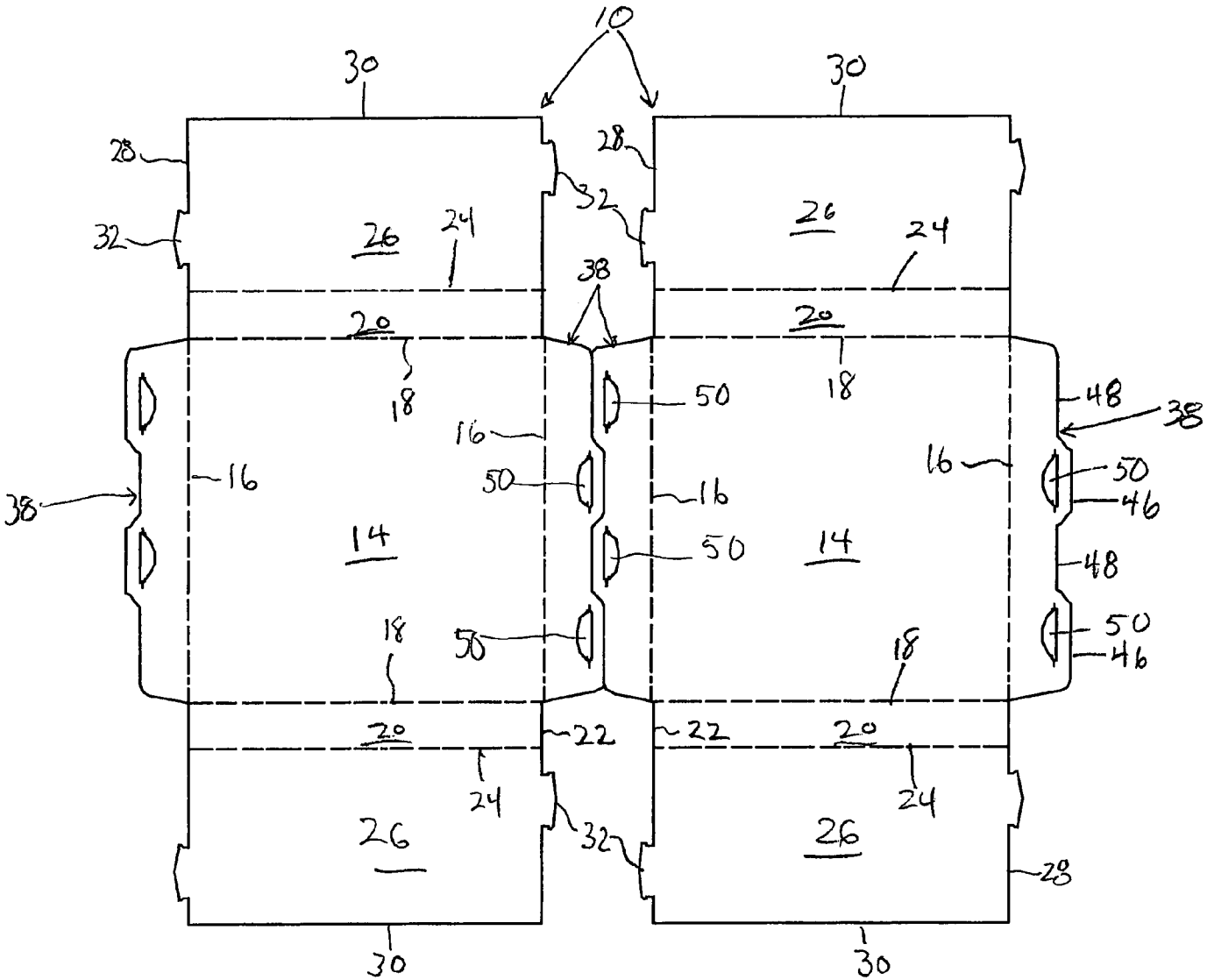
FIG. 6 is a plan view of a pair of matable, side-by-side blanks.

To further increase the packaging efficiency, a pair of identical blanks 10 are placed in side-by-side, mating configuration as shown in FIG. 6. This mating configuration is made possible by the shape and alignment of the notched or contoured edges 40 on side panels 38 of adjacently disposed blanks 10. More precisely, the extended portions 46 and recesses 48 on the left side panel 38 of the right hand blank 10 matingly engage with corresponding extended portions 46 and recesses 48 on the right side panel 38 of the left hand blank 10. This mating, side-by-side configuration reduces the overall size of each blank 10, which has the practical benefit of providing a significant reduction in material and cost. This mating configuration also creates a packaging area where multiple pizzas can be quickly loaded, cut and packaged before delivery or pick up. Although only two side-by-side blanks 10 are shown, it is noted that the lay flat design of the blanks 10 enables two side-by-side stacks of mating blanks 10.

Figure 7:
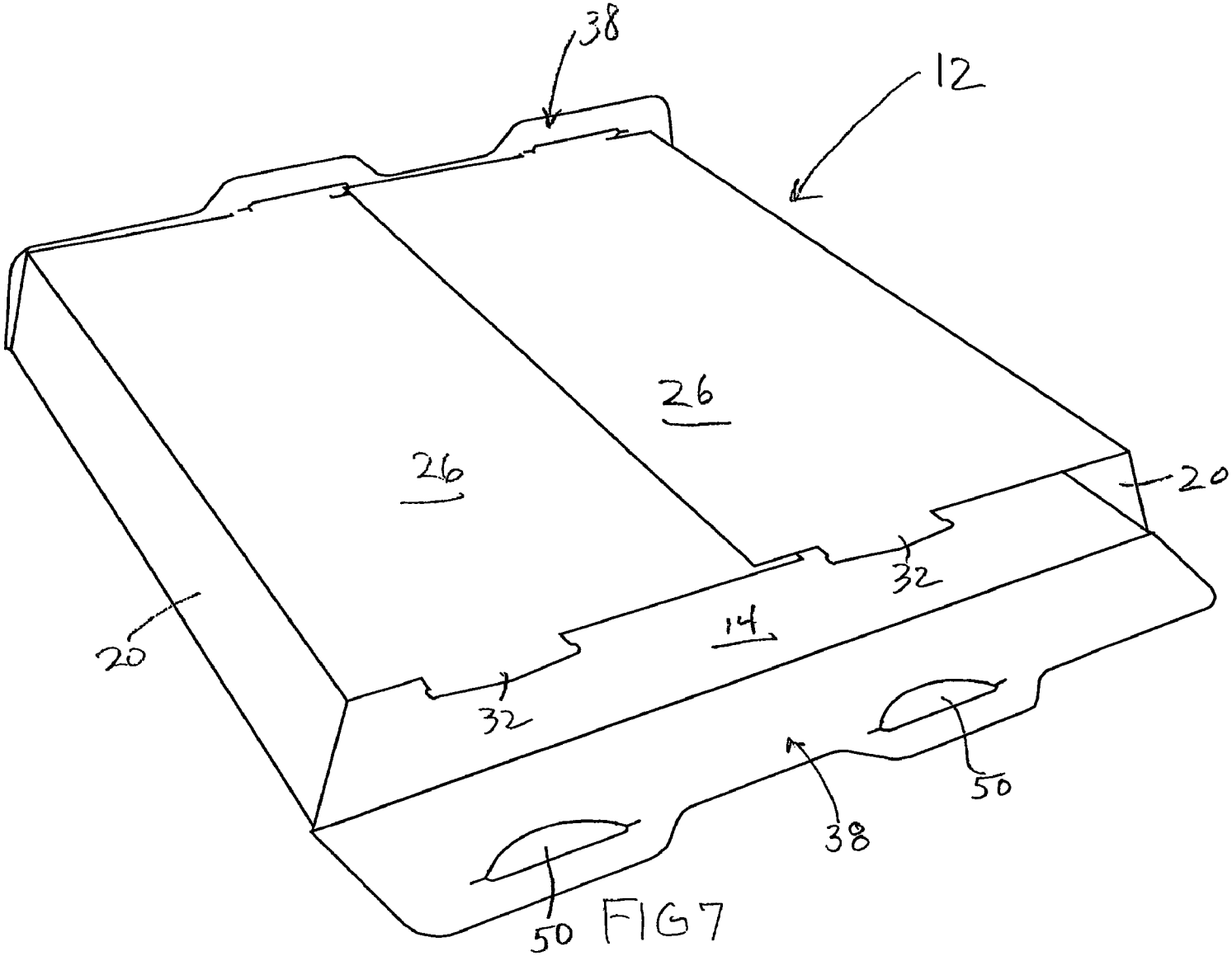
FIG. 7 is a perspective view of a folded carton having one side panel disengaged from the cover panels.
Figure 8:
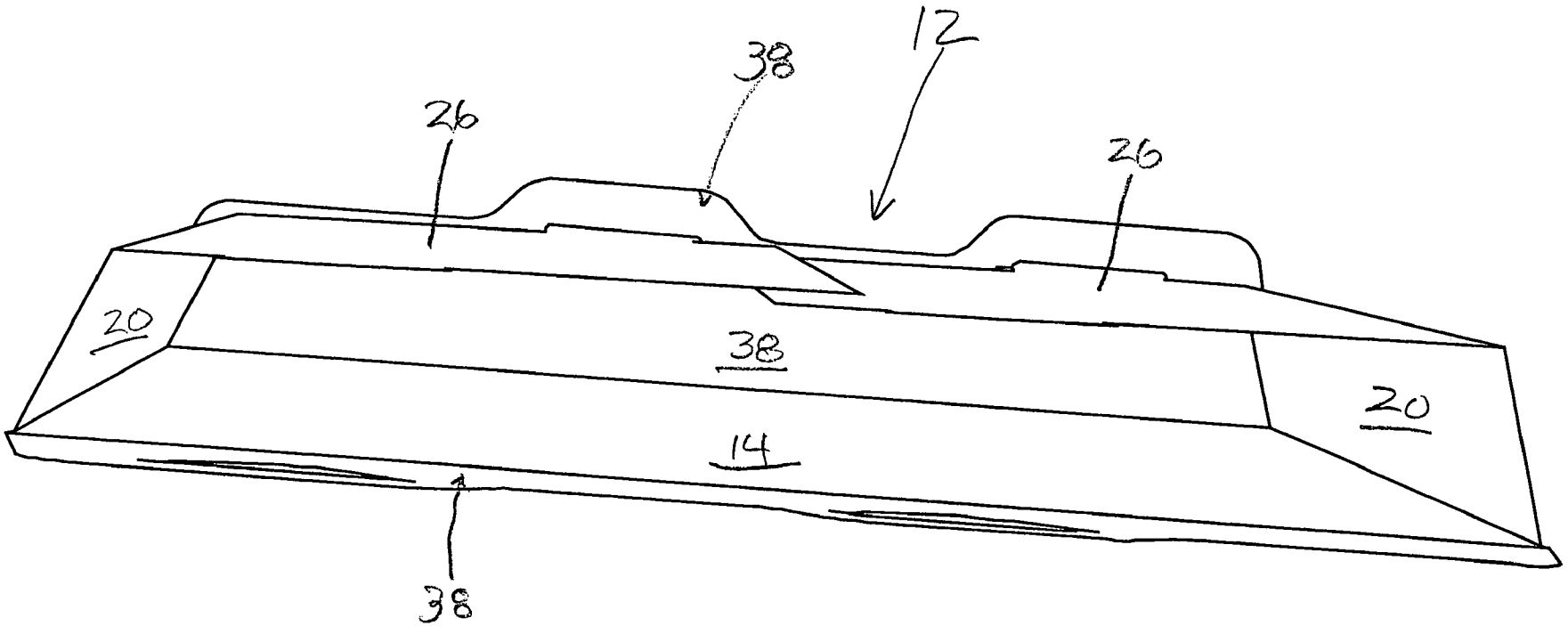
FIG. 8 is an elevational view looking into the open carton of FIG. 7.
Figure 9:
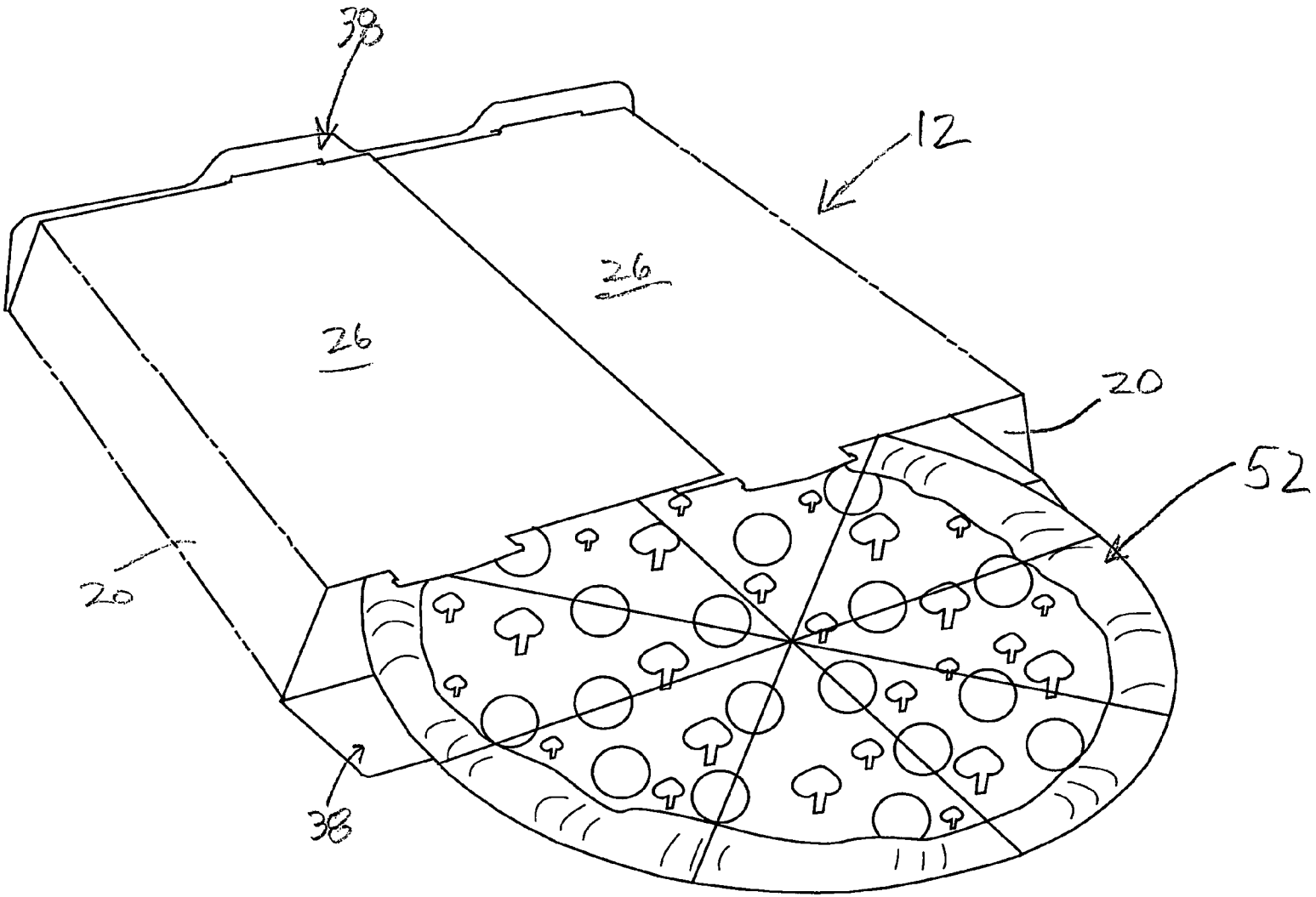
FIG. 9 is a view like FIG. 7 showing the loading of a pizza.

Referring now to FIGS. 7, 8 and 9, an alternative use of the blank 10 involves partially erecting or forming the carton 12 by leaving one of the side panels 38 down so that a pizza 52 may be loaded from the side of the carton 12. After the pizza 52 has been inserted onto the bottom panel 14, the open side panel 38 is folded upwardly to engage the tabs 32 with the walls of the openings 50 to form completed carton 12.

Once blank 10 has been set up into carton 12, certain special structural arrangements occur. As seen best in FIGS. 2 and 8, end panels 20 slant upwardly and inwardly and lie at an acute angle relative to the bottom panel 14. The inwardly-sloping end panels 20 increase the amount of overlap of the cover panels 26 and enable a reduction in the amount of paperboard required in the cover panels 26. This saves on manufacturing costs in comparison to cartons having vertical walls or panels. The acutely-slanted end panels 20 also add to the rigidity of the carton 12 when another loaded carton 12 is placed on top. That is, the tapered end panels 20 prevent a loaded carton 12 placed on top from nesting into a loaded carton 12 below. Further, the inwardly-sloping end panels 20 serve to somewhat reduce shifting of the pizza 52 during transport to prevent damage thereto.

Figure 10:
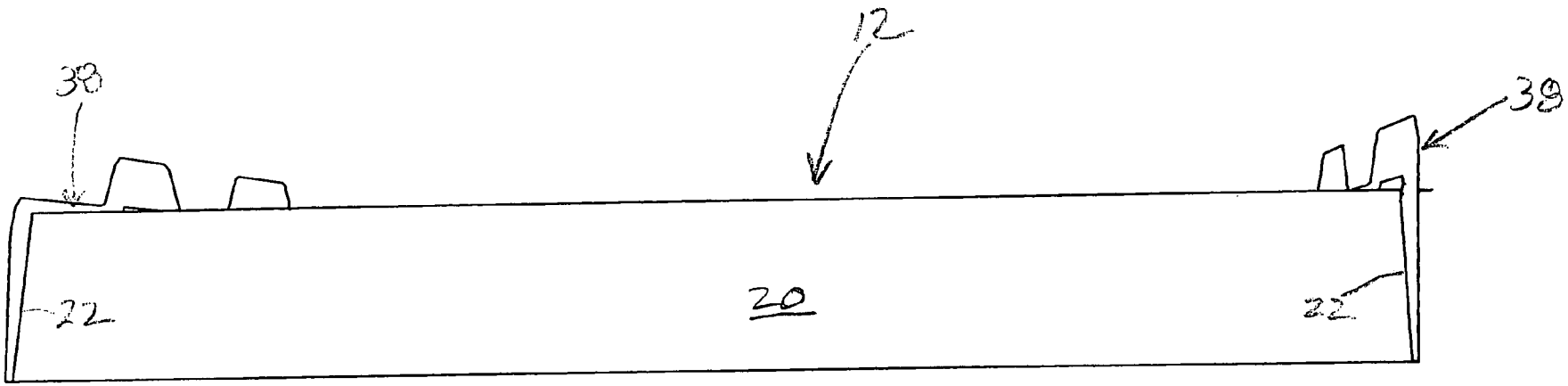
FIG. 10 is an elevational view of the carton looking in the direction of an end panel.
Figure 11:
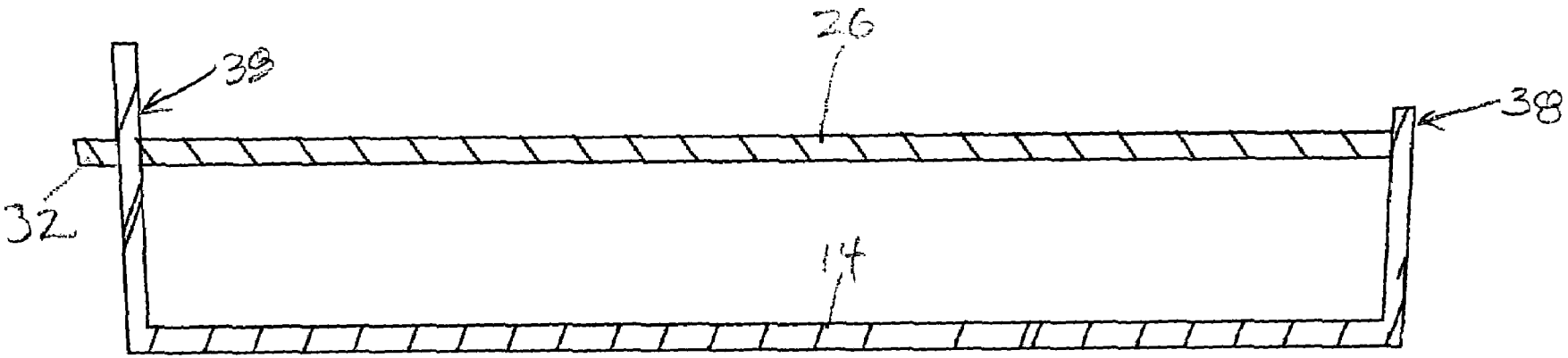
FIG. 11 is a sectional view taken on line 11-11 of FIG. 4.
Figure 12:
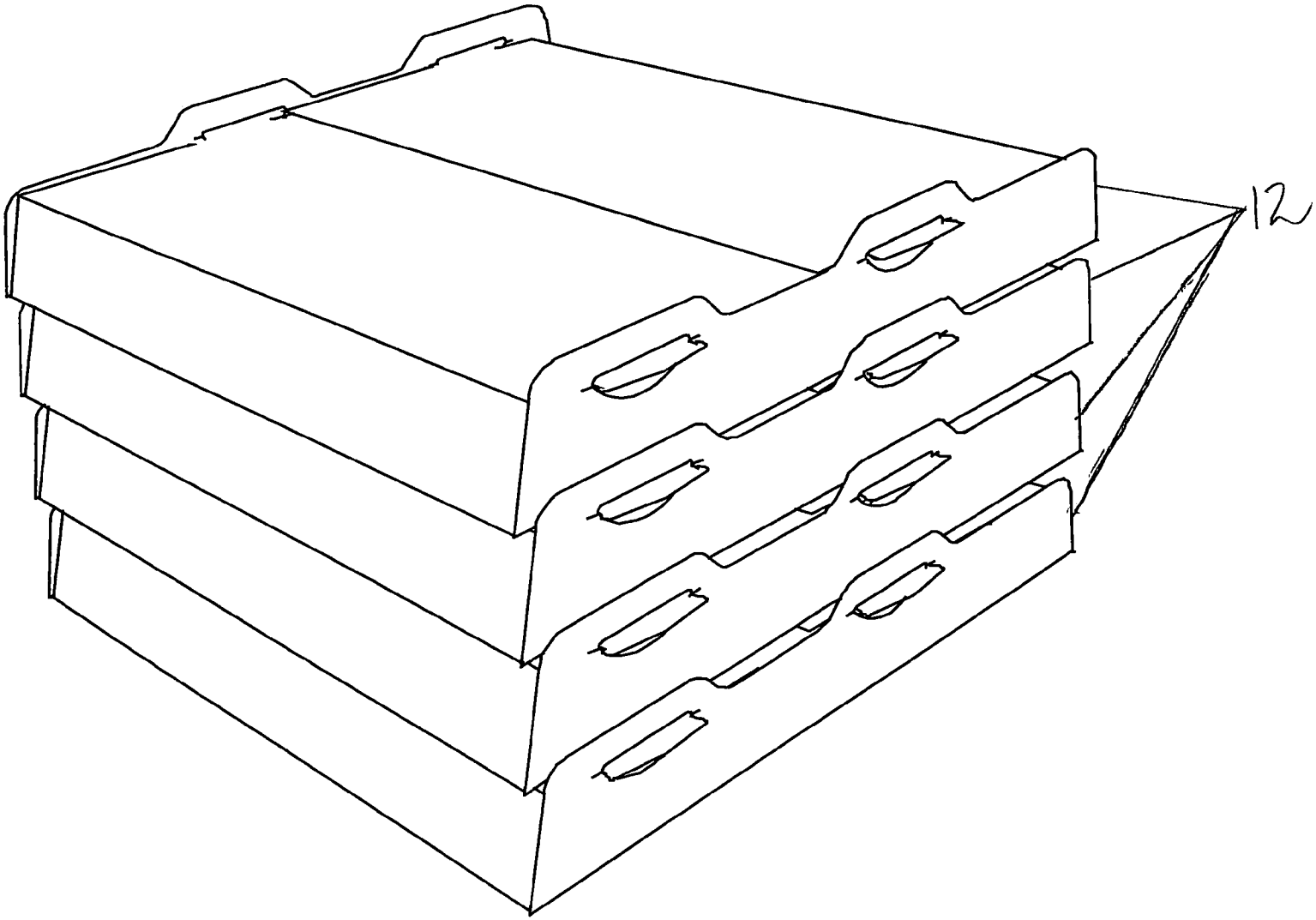
FIG. 12 is a perspective view of a series of vertically-stacked folded food cartons.
Figure 13:
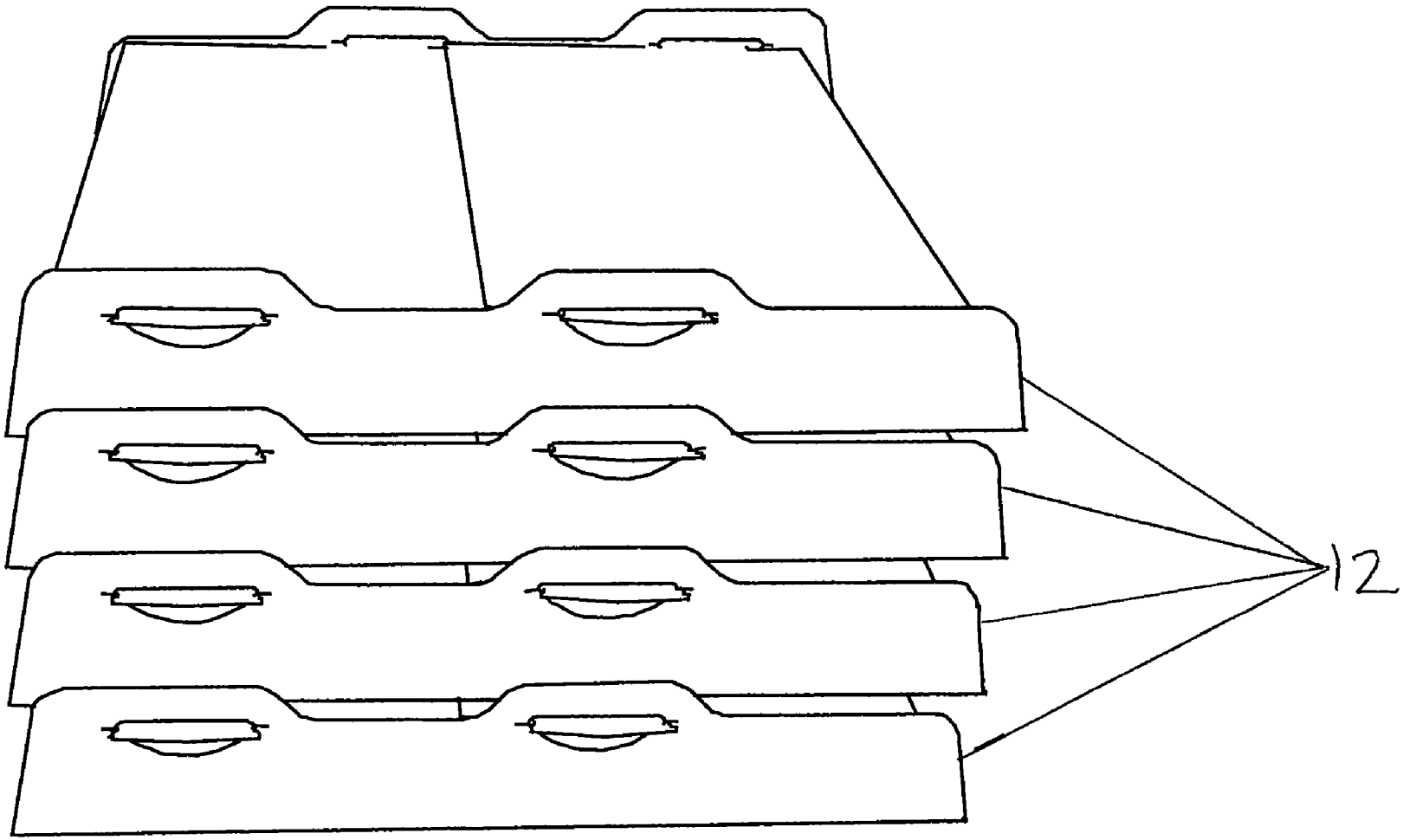
FIG. 13 is a perspective view of FIG. 12 as seen from one of the side panels.
Figure 14:
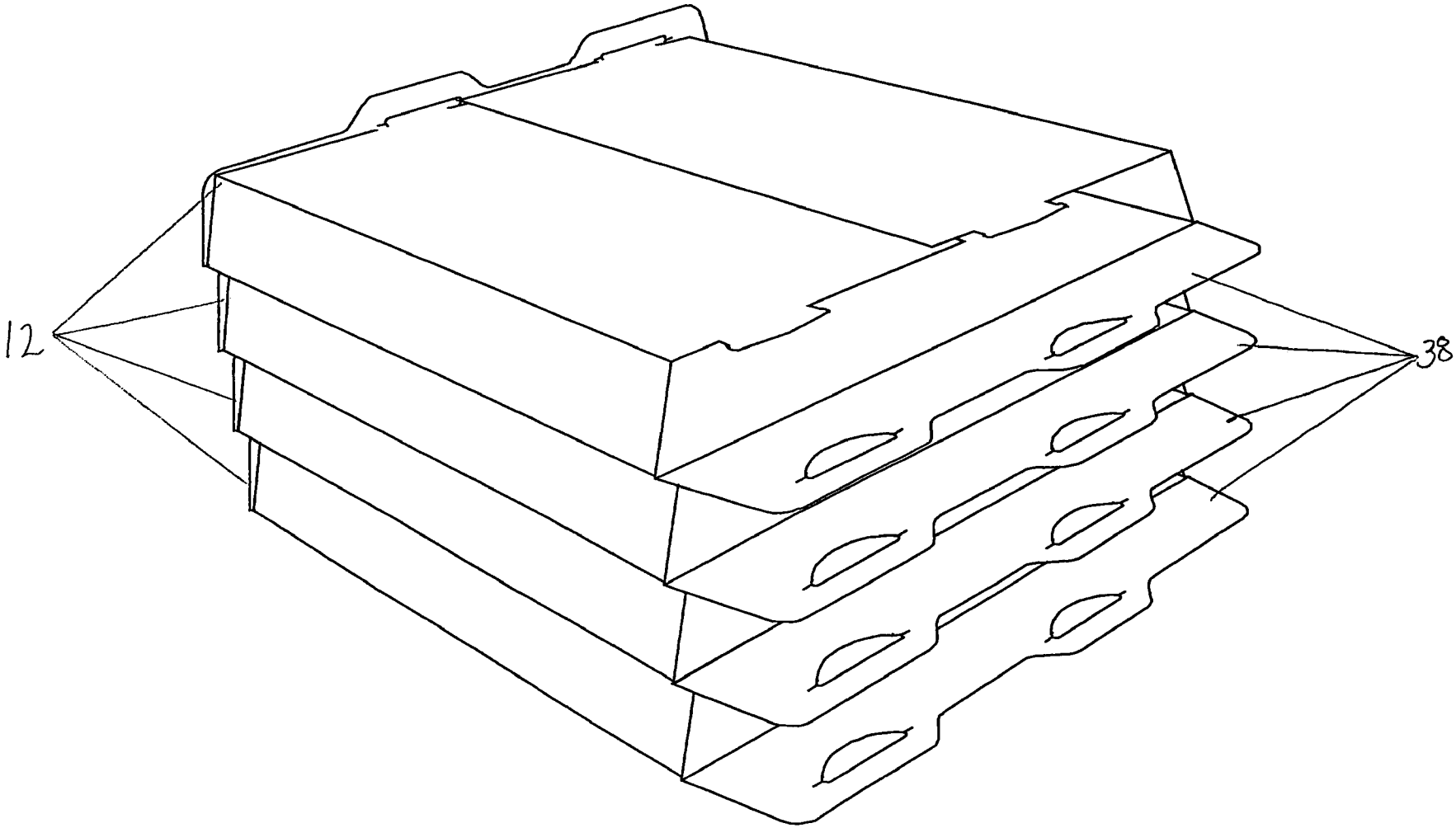
FIG. 14 is a perspective view of a series of vertically-stacked cartons as shown in FIG. 7.

In addition, side panels 38 on the finished carton 12 diverge slightly outwardly at an obtuse angle relative to the bottom panel 14 as best illustrated in FIGS. 10 and 11. This outward slanting of side panels 38 is enabled by the angled side edges 22 of end panels 20. It can also be appreciated that in the formed carton 12, the extended portions 46 of side panels 38 lie upwardly above the surface of the cover panels 26. As a result of these structural features, the side panels 38 aid in over extension and buckling of the cover panels 26 when assembled, and serve as lateral guides in the stacking of loaded or unloaded cartons 12 of similar size on top of each other as depicted in FIGS. 12, 13 and 14. The extended portions 46 stabilize the carton 12 when the cartons are stacked and transported, and prevent side-to-side shifting of the stacked cartons relative to each other.

It should now be appreciated that the present invention provides a material-saving, quickly erected carton especially useful in retaining, transporting and serving hot, flat food such as pizza. The carton is designed with inwardly slanting end panels, outwardly-sloping side panels and a pair of overlapping cover panels which interlock with the side panels. As described above, the structure of the end panels, the side panels and the cover panels enhance the rigidity, stackability, venting capability and manufacturing cost effectiveness of the carton. The blank used to form the carton has a symmetrical design, which reduces erecting and closing labor. The lay flat design of the blank speeds the cutting and packaging process and facilitates easy serving. Furthermore, the blank promotes direct loading of the pizza from the oven, which further reduces labor and lessens potential contamination. Moreover, the blank has a mating configuration to increase the efficiency of the packaging process. Placing the pizza on the blank and erecting the carton around the pizza eliminates the need for pre-erecting the carton, opening the carton, loading the pizza and then reclosing the carton.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

We claim:

1. A pizza box formed from an integral blank of material, the pizza box comprising:

a substantially flat and rectangular bottom panel;

a pair of opposed end panels and a pair of opposed, first transverse fold lines, each end panel being hingedly joined to the bottom panel along its respective first transverse fold line;

a pair of opposed cover panels and a pair of opposed, second transverse fold lines, each cover panel being bingedly joined to its respective end panel along its respective second transverse fold line, each cover panel having opposed longitudinal edges, and each cover panel having a set of opposed locking tabs extending outwardly from the longitudinal edges;

a pair of side panels hingedly joined to the bottom panel along a pair of opposed longitudinal fold lines, each side panel having openings for frictionally receiving the locking tabs on the cover panels; and, wherein the pizza box is foldable along the fold lines into a closed position by folding the side panels, end panels and cover panels, the cover panels being generally parallel to the bottom panel, overlapping each other and interlocking with the side panels via the locking tabs, the end panels slanting inwardly and upwardly relative to the bottom panel, the side panels slanting outwardly and upwardly relative to the bottom panel, and the side panels extending above the cover panels.

2. The pizza box of claim 1, wherein each end panel has opposed side edges diverging outwardly from ends of the first transverse fold lines to ends of the second transverse fold lines, the end panels are trapezoidal in shape.

3. The pizza box of claim 1, wherein the side edges of each side panel extend at an acute angle relative to the second transverse fold lines.

4. The pizza box of claim 1, wherein each cover panel is substantially rectangular and each locking tab is formed with a pair of outwardly diverging edges and a pair of outwardly extending, converging edges.

5. The pizza box of claim 1, wherein the locking tabs on each cover panel are offset with at least one of said locking tabs lying adjacent the second transverse fold line and the other one of said locking tabs being positioned adjacent an outer end of the cover panel.

6. The pizza box of claim 1, wherein the longitudinal fold lines lie parallel to a longitudinal axis passing through the bottom panel, and the first and second transverse lines lie parallel to each other and transverse to the longitudinal axis.

7. The pizza box of claim 1, wherein each side panel is formed with a contoured outer edge, a pair of shoulders and a pair of side edges disposed at acute angles relative to one of the longitudinal fold lines.

8. The pizza box of claim 7, wherein the contoured outer edge include a pair of spaced apart extended portions and a pair of spaced apart recesses, the extended portions and recesses on one side panel being offset relative to the extended portions and recesses on the opposite side panel.

9. The pizza box of claim 8, wherein the openings formed in each side panel lie inwardly of the extended portions.

10. The pizza box of claim 1, wherein the openings are sized to permit venting of a hot food product packaged in the pizza box.

11. The pizza box of claim 1, wherein upon folding the end panels, the side panels and the cover panels, the end panels are oriented at an acute angle relative to the bottom panel.

12. The pizza box of claim 1, wherein upon folding the end panels, the side panels and the cover panels, the side panels are oriented at an obtuse angle relative to the bottom panel.

13. The pizza box of claim 1, wherein the outwardly-slanting side panels facilitate vertical stacking of other pizza boxes one on top of the other and define guides to prevent side-to-side shifting of the other pizza boxes stacked upon the cover panels.

14. The pizza box of claim 1, wherein the end panels are substantially trapezoidal in shape.

15. The pizza box of claim 1, wherein each end panel has opposed side edges diverging outwardly from ends of the first transverse fold lines to ends of the second transverse fold lines.

16. The pizza box of claim 1, wherein each cover panel is substantially rectangular.

17. The pizza box of claim 1, wherein each locking tab is formed with a pair of outwardly diverging edges and a pair of outwardly extending, converging edges.

* * * * *